United States Patent [19]

Frantzen

[11] 4,264,410

[45] Apr. 28, 1981

[54] METHOD OF MAKING AN ABRADING MATERIAL

[75] Inventor: John J. Frantzen, White Bear Lake, Minn.

[73] Assignee: Minnesota Micro Metal, Inc., St. Paul, Minn.

[21] Appl. No.: 114,253

[22] Filed: Jan. 22, 1980

Related U.S. Application Data

[62] Division of Ser. No. 934,206, Aug. 16, 1978.

[51] Int. Cl.[3] ..... C23F 1/02

[52] U.S. Cl. ..... 156/659.1; 156/640; 156/654

[58] Field of Search ..... 29/76 R–77, 29/78–80; 51/204, 206 R, 209 R, 212, 293, 295, 309, DIG. 30; 428/932; 156/640, 654, 659.1, 655, 656; 125/2, 9, 22

[56] References Cited

U.S. PATENT DOCUMENTS

| | | | |
|---|---|---|---|
| 3,045,321 | 7/1962 | McDermott | 29/78 |
| 3,905,080 | 9/1975 | Bond | 29/76 R |
| 4,099,935 | 7/1978 | Bond et al. | 51/309 R |

*Primary Examiner*—William A. Powell

*Attorney, Agent, or Firm*—Neil B. Schulte

[57] ABSTRACT

A metal abrading material formed from acid etching with a resist pattern comprising a plurality of polygonal shapes with accentuated corners dispersed in a pattern chosen to intermix cutting points with planing edges.

8 Claims, 10 Drawing Figures

FIG. 1
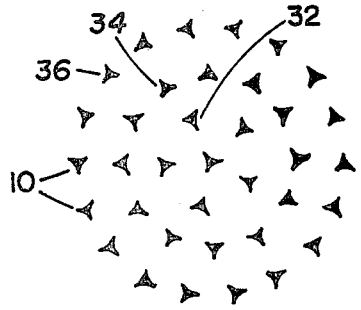
FIG. 2
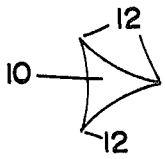
FIG. 3
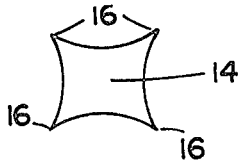
FIG. 4
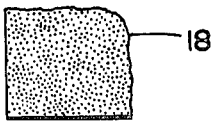
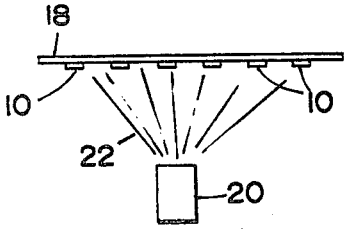
FIG. 5
FIG. 6
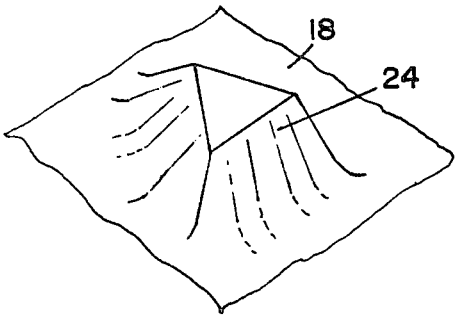
FIG. 7
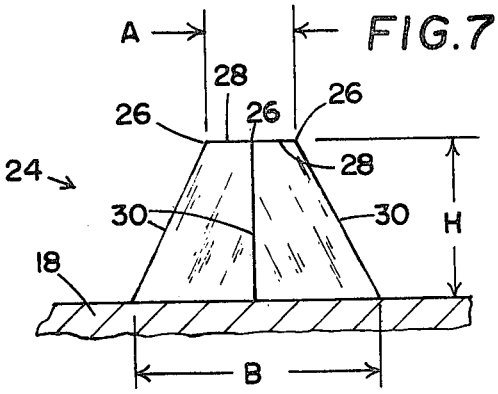
FIG. 8
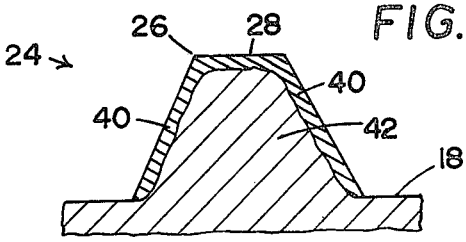
FIG. 9
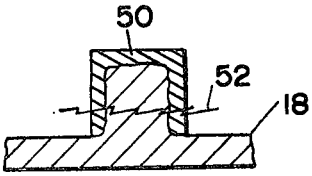
FIG. 10
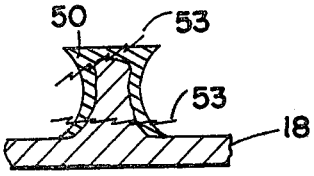

METHOD OF MAKING AN ABRADING MATERIAL

This is a division of application Ser. No. 934,206, filed Aug. 16, 1978.

BACKGROUND OF THE INVENTION

Metallic abrading devices produced through an etching process with a suitable resist are known to the prior art and typified by U.S. Pat. No. 3,045,321. This patent discloses the process in which a major portion of the surface of a sheet of metal is etched away leaving only portions of the material positioned underneath chosen islands of resist so as to create a set of sharp regular points on the surface of the metal. Such a process produces an abrading material that operates primarily through a scratching or gouging operation and produces a rather rough surface.

Another prior art approach, typified by U.S. Pat. No. 3,905,080, shows an abrading material produced from etching wherein the etching process is allowed to proceed backwards underneath the resist to undercut the points and create cutting edges. Such edges result in a smoother finished surface. However, the remaining cutting teeth have flat tops and do not penetrate very well. Accordingly, the abrading rate is very slow and using a tool with this material is tedious. These prior art metallic abrasion materials have not gained commercial acceptance because they simply are not as effective as competing sandpapers in getting the job done, although they are longer lasting since the metal is more durable. My invention contemplates an entirely new approach to the production of etched metallic abrasives which yields a product much superior to that in the prior art. The above problems are overcome so that both speed and smooth finish are obtainable.

SUMMARY OF THE INVENTION

Briefly, the present invention incorporates the use of a special resist pattern which gives an even intermixing of fast working sharp points with smoothing planing edges. The cutting teeth are formed in the shape of triangles or squares which come out of the etching process still sharp and useable due to the special configuration of the resist pattern which accentuates the corner portions. The etched metallic abrading material is hardened by heat treating to strengthen the cutting points and edges. In the prior art it is not possible or desirable to harden by heat treating since the hardening process will make the cutting teeth so brittle that they simply break off in use. However, with the proposed special resist pattern disclosed herein the base of the teeth is maintained at a larger dimension so that a sufficient amount of non-hardened material will remain inside the tooth to provide the mechanical support therein. Thus, it may be seen that it is an object of my invention to provide a novel method of producing abrasive materials and a new and novel abrasive material itself. It is a further object of my invention to provide a metallic etched abrasive which removes material at a faster rate while still producing a smooth surface. Further objects and advantages will become apparent upon consideration of the following detailed description and drawings.

BRIEF DESCRIPTION OF THE DRAWINGS

FIG. 1 shows a greatly enlarged view of the resist pattern of one embodiment of the invention.

FIG. 2 and FIG. 3 show alternative triangular and square resist elements with accentuated corners as used in the present invention.

FIG. 4 shows a fragment of the metal base having the resist pattern applied thereto.

FIG. 5 shows the etching process used in the present invention.

FIG. 6 and FIG. 7 show respectively perspective and elevational views of one of the cutting teeth resulting from the resist element shown in FIG. 2.

FIG. 8 is a sectional view of one of the teeth showing the effect of the hardening process.

FIGS. 9 and 10 show the inapplicability of the process of hardening by heat treating to prior art etched abrasives.

DESCRIPTION OF THE PREFERRED EMBODIMENT

In FIG. 1 one embodiment of the resist pattern is shown. The pattern includes a number of elements of resist 10 which are formed in the shape of three or four sided polygons having accentuated corners. In FIG. 1 and FIG. 2 a triangular shape is shown with accentuated corners 12. In FIG. 3 a four sided polygon or square 14 is shown for the element of resist with accentuated corners 16. Typically the chosen pattern of FIG. 1 is multiplied many times over and applied to a suitable metallic base 18 as shown in FIG. 4. The base 18 with the resist elements 10 thereon is then subjected to an etching spray 22 from a suitable nozzle 20 in a manner well known to those skilled in the art. This step is shown in FIG. 5. If a triangle type resist element is employed the tooth 24 shown in FIG. 6 results after the residual resist is removed. As shown in FIG. 7 tooth 24 has sharp cutting points 26 which operate to quickly remove material during the abrasion process. However, tooth 24 also has sharp planing edges 28 which simultaneously smooth the roughened surface and remove material between the gouged tracks made by the points 26. To properly intermix the fast cutting points 26 and the smooth planing edges 28, the pattern of FIG. 1 is carefully arranged so that the elements of resist are all positioned in slightly different directions. For example, in FIG. 1 it will be noted that the first concentric ring of resist elements 10 designated by the numeral 32 point inward while the second concentric ring of elements 34 all point outward. The third concentric ring of elements 36 are tilted relative to the first two rings. This randomizing process may be continued outward and then repeated numerous times to form the pattern shown in FIG. 4. In this way all of the elements of resist and all of the resulting teeth are randomly oriented so that an even intermixture of deep cutting points and smooth planing edges is assured.

To assure that the teeth remain strong and tough they are hardened by heat treating in a conventional manner to produce a hardened layer 40 as shown in FIG. 8. The shape of the resist pattern and the etching process are carefully controlled to leave a substantial amount of non-hardened metal 42 inside the tooth so as to properly support the cutting points 26 and the planing edges 28.

Typically, dimension A in Fig. 7 is about 3 mils with the width of the base B being about twice A. The height of the tooth 24, dimension H, is also about twice A.

Because of the accentuated corners in the resist pattern and with proper etching control, the edges of the tooth are kept relatively straight, extending from the corners outward to the base at an angle sufficient to provide good mechanical support to the cutting corners 26 and the planing edges 28 extending therebetween. This mechanical support resists the forces of abrasion which is especially important when the tooth is hardened and becomes more brittle. The prior art teeth, such as are typified by the vertical and undercut shapes shown in FIGS. 9 and 10, would not be suitable to a hardening process producing a layer 50 as shown. Such a result has been found by experiment to be unacceptable in that the tooth is severely weakened structurally by the hardening process so that it breaks off in the areas designated by the jagged lines 52 and 53.

When metal is etched, corners are attacked from both sides and accordingly retreat at a greater rate than the sides of the elemental piece of resist. Accordingly, the points are soon rounded off before the edges can be properly created. The accentuated corner utilized in the resist element of the present invention compensates for this effect leaving well defined outward slanted edges on the cutting tooth 24 which extend to a larger base so that the hardened layer 40 can be applied as shown in FIG. 8 while still keeping a structurally sound tooth 24.

I claim:

1. The method of forming abrasive material comprising the steps of:

printing a multiplicity of elements of etching resistant material on smooth metal sheets, said elements being basically polygonal in shape but having extended accentuated corners;

etching away the surface of the metal sheets not protected by said elements to as to leave protrusions with cutting corners and planing edges; and removing the etching resistant material.

2. The method of claim 1 in which said elements are generally triangular.

3. The method of claim 1 in which said elements are generally square.

4. The method of claim 1 including the step of hardening said protrusions by heat treating the protrusions.

5. The method of claim 1 in which the etching step is continued long enough to leave a base portion closer to the metal sheet larger in size than the top portion of the protrusions closer to the element of etching resistant material.

6. The method of claim 5 including the step of hardening said protrusions by heat treating the protrusions.

7. The method of claim 6 in which said elements are generally triangular.

8. The method of claim 6 in which said elements are generally square.

* * * * *